United States Patent [19]

Torroja et al.

[11] 4,233,921

[45] Nov. 18, 1980

[54] TRANSPORT VESSELS HAVING LIQUID GAS STORAGE TANKS

[75] Inventors: Jaime M. Torroja, Madrid; José U. Rivacoba, Bilbao; Ricardo M. Herrero, Madrid, all of Spain

[73] Assignee: Sener Ingenieria y Sistemas, S.A., Madrid, Spain

[21] Appl. No.: 6,859

[22] Filed: Jan. 26, 1979

[30] Foreign Application Priority Data

Jan. 31, 1978 [ES] Spain ..... 466.499

[51] Int. Cl.[3] ..... B63B 25/14

[52] U.S. Cl. ..... 114/74 R; 220/448; 220/901

[58] Field of Search ..... 114/74 R, 74 A, 74 T; 220/445, 448, 446, 901

[56] References Cited

U.S. PATENT DOCUMENTS

| | | | |
|---|---|---|---|
| 3,276,412 | 10/1966 | Estes et al. | 114/74 A |
| 3,516,567 | 6/1970 | Hemphill | 220/448 X |
| 3,899,988 | 8/1975 | Menendez | 114/74 R X |
| 3,903,824 | 9/1975 | Laverman et al. | 114/74 A |
| 4,127,079 | 11/1978 | Ito | 114/74 R |
| 4,128,070 | 12/1978 | Shadid et al. | 114/74 A |

FOREIGN PATENT DOCUMENTS

| | | | |
|---|---|---|---|
| 2304509 | 10/1976 | France | 114/74 A |

*Primary Examiner*—Trygve M. Blix
*Assistant Examiner*—Winston H. Douglas
*Attorney, Agent, or Firm*—Wigman & Cohen

[57] ABSTRACT

A transport vessel especially used in connection with the transportation of liquid gases, e.g., natural gas, includes means for isolating storage tanks from the hull of the vessel to minimize the deformations to the tank from the hull. In this way, the thickness and hence weight of the tanks may be significantly reduced.

12 Claims, 9 Drawing Figures

TRANSPORT VESSELS HAVING LIQUID GAS STORAGE TANKS

BACKGROUND OF THE INVENTION

This invention relates generally to improvements in vessels equipped with independent pressurized tanks resting against contiguous coverings or shells and, in particular, to those vessels used in the transport of low temperature liquid gases, such as natural gas.

The use of natural gas, greatly in demand today as a source of energy, is limited by the problems associated with its transfer from sources located in the Middle East to the consumer countries.

Until the present time the means used to transport natural gas are based on vessels equipped either with large holds that enclose membranous containers resting along the bottom and the walls of said holds, or, with large, independent tanks resting against contiguous coverings which, in turn, transmit the loads to the hull of the ship.

The use of membranous containers requires a highly specialized work crew and special materials and technology for their manufacture, and monopolizes dockyard facilities for long periods of time.

In comparison, the independent load tanks do not necessitate the use of highly specialized crews or materials for their manufacture and also involves shorter periods of work time. Although the materials required are not so specialized as those required by the membranous containers, they are of considerable weight due to the thickness of the plates necessary for their construction. The thick plates are a necessary factor so as to ensure the stability of the tank wall. In an independent tank resting against contiguous coverings the stability of the wall may be endangered by forces of compression that give rise to pressures greater than or equal to the maximum levels.

Compression pressures in the tanks in question are due to forces of inertia when the vessel is seabound, to the weight of the tank and its load, and to deformations in the vessel hull due to waves.

Deformations in the hull of the ship may require a tank wall to be up to 30% thicker than the width already required by the two aforementioned causes.

It is impossible to reduce the influence of gravity and almost impossible to reduce the forces of inertia. However, it is possible to reduce the pressures on the tank wall due to deformations of the hull, and consequently the width of said wall and the weight of the tanks.

At the present time one method to reduce these pressures is known. It was developed by the applicants and/or assignees of the present invention and consists of controlling and maintaining deformations to the hull within predetermined limits so that they do not rise to high levels.

OBJECT AND SUMMARY OF THE INVENTION

The object of the present invention is to provide a system that will reduce the pressures induced in the tank and in its support hulls by the vertical deformations of the vessel hull, due mainly to vertical flexion and torsion of the vessel that do not have to affect its hull.

The covering(s) making up the foundation of the tank rest on a support wall which transmits the loads to the hull of the vessel. The support wall is set upon by platform which is substantially horizontal.

Up to the present time, the support covering(s) of each tank rested directly on the platform in question, and thus the deformations in the hull of the vessel had a direct effect on the coverings and the wall of the tanks, giving rise to pressure which necessitated that the wall of the tanks be reinforced.

The present invention is based on the relative isolation of each load tank from the vessel hull, thus maximally separating the vertical deformations of the hull from those of the tank.

For this purpose, deformable vertical support elements are used between the base of the support covering(s) of each tank and the top of the support structure.

In accordance with the present invention on top of the platform on which the support covering (s) rests, a continuous sheet substantially parallel to said platform, is used. Between the platform and the continuous sheet, there is placed a deformable element. The continuous sheet is connected to the platform by means of at least one intermediate element.

The continuous sheet, as well as the platform under which the support wall stands, has a central opening through which the tank passes.

The covering(s) making up the tank foundation are joined by their interior border to the above-mentioned continuous sheet.

The deformable element mentioned above is thus able to transmit the perpendicular forces from the hull of the boat through the continuous sheet and the platform between which the intermediate element rests. The continuous sheet must be very rigid on its own level and very flexible outside its level so that it can transmit the parallel forces from the hull of the vessel in the form of sharp pressures, while at the same time allowing the vertical deformations of the deformable element.

The deformable element may be a continuous elastic body in the form of a ring, situated beneath the juncture area of the tank support covering(s) and the continuous sheet, so that it surrounds the central opening of said continuous sheet.

The deformable element may also be made of one or more tubular chambers with flexible walls, preferably not of elastic, partially filled with a low compression fluid. These chambers, as in the case of the elastic body or bodies, are placed beneath the juncture area between the tank support covering(s) and the continuous sheet, surrounding the central opening of said continuous sheet.

As known, the vertical deformations of the hull of a vessel at sea are mainly due to the general vertical flexion of the hull and the effects of its torsion.

The deformations of the hull in the area of a load tank due to general vertical flexions are symmetrical with respect to the vertical longitudinal symmetry plane of the vessel and to the vertical transverse median plane of the tank. The deformations due to torsions are symmetrical with respect to the bisecting planes of the two aforementioned elements.

This means that when the hull is altered due to general vertical flexion the platform rises above its plane so that between the platform and the continuous sheet there appear two symmetrical approximation zones and another two symmetrical separation zones, located near the vertical longitudinal and transverse planes mentioned above. The same effect occurs due to torsion; however, in this latter case the approximation and separation zones of the platform and the continuous sheet are located near the previously mentioned bisecting planes.

Where the deformable element is made of one or more elastic units, these units due to their elasticity, can compress or expand, thereby absorbing the separation variations between the platform and the continuous sheet. In this manner, the deformations of the hull do not affect the tank itself or its support.

When the deformable element is made of one or more tubular chambers, the width variations and also the sectional variations of these chambers can occur only when there is an alteration in the quantity of fluid contained in the different sections or areas of the chambers. This sectional variation occurs by circulation of the fluid from the areas of the ringed chamber which are compressed, due to the approximation of the platform to the continuous sheet, to the areas in which said chamber is free, when the platform separates from the continuous sheet.

This requires that each of the ringed chambers contain an approximation area and a separation area, or one area of one type and two median areas of the other, so that the total quantity of fluid contained in each chamber remains constant and the median distance between the platform and the continuous sheet does not change when the vessel undergoes deformations.

To impede gyrations of the tank around a shaft perpendicular to a longitudinal plane, it is necessary that, at least in one of the chambers, the flow of fluid be impeded by means of the median transverse plane of the tank. In like manner, to impede gyrations of the tank around a shaft perpendicular to its median transverse vertical plane, it is necessary that, at least in one of the chambers, the flow of fluid be impeded by means of the longitudinal plane.

In order to meet the above conditions, the deformable element may be made up of four series of concentric tubular chambers, each chamber occupying an arc slightly less than a semicircle, two of the chamber series being contained within the other two in the series. The two interior series are placed symmetrically with respect to a vertical plane and the two exterior chambers are symmetrical to a different vertical plane, preferably perpendicular to the former.

In order to avoid lateral displacement of the chambers, each of them is mounted between two partitions that rise perpendicularly from the platform. These partitions run the length of the concentric semicircle.

The partitions are of a height and separated in a manner such that maximum possible flattening of the chamber housed between them is permitted without the continuous chamber coming into contact with said partitions and without any lateral restriction on the local flattening of the chamber.

Clamps may be used to reposition the tubular chambers. These clamps would raise the continuous sheet slightly, separating it from the platform. The sheet may also be raised by swelling some of the chambers to the maximum.

Generally, the tubular chambers are equipped with loading holes and with manometers that will allow the equalization of pressures in the different chambers so that each will function equally.

Where they come into contact with the tubular chambers, the platform and the continuous sheet may have an antiabrasive coating so that the chambers will be provided with more durability.

The intermediate element(s) that connect the continuous sheet to the platform may be situated within or outside the area occupied by the deformable element.

In the case of the former, the intermediate element may consist of a continuous curved cross section which is joined to the internal edge of the continuous sheet and at the longitudinal edge of one of its walls and to the platform at the longitudinal edge of the other wall. It may also be made of a continuous partition perpendicular to the platform and continuous sheet, a partition which is joined along its upper edge to the continuous sheet and to the platform along its lower edge.

In addition to the intermediate element described, between the platform and the continuous sheet there may also be a continuous perpendicular partition joined to said platform and said continuous sheet by its edges. This partition surrounds the above-mentioned intermediate element and is placed between the latter and the deformable element.

Should the intermediate element be placed outside the area occupied by the deformable element, said intermediate element may consist of a continuous partition placed between the platform and the continuous sheet, extending between them perpendicularly and joined to them by its upper and lower edges. The partition surrounds the deformable element and is placed between said deformable element and the walls of the hold.

The continuous sheet may extend to the vessel walls of the hold to which it is joined, supporting said walls, in the limited area between the continuous sheet and the platform.

Lastly, the intermediate elements may be comprised of anchoring pins placed between the platform and the continuous sheet, inside and outside the deformable element.

The characteristics and the embodiments of the present invention described heretofore will be better understood by the description which follows which refers to the drawings.

DETAILED DESCRIPTION OF PREFERRED EMBODIMENTS

Figure 1:
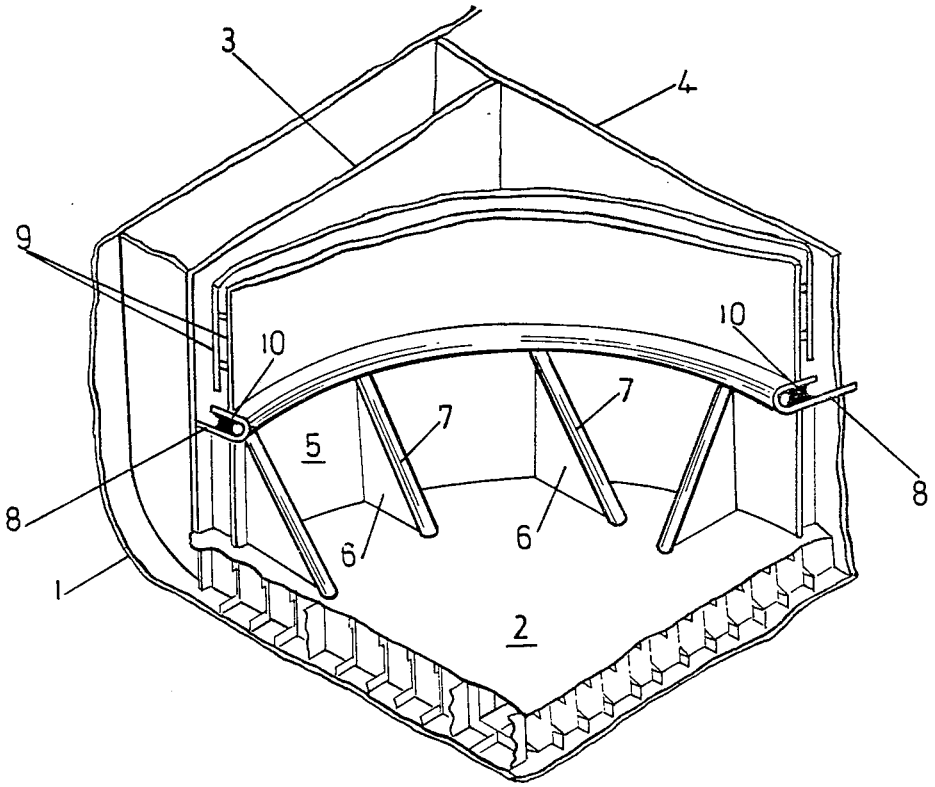
FIG. 1 is a partial perspective view showing in section the structure of the vessel hull, the support wall, and the support coverings of a tank according to the present invention.

As may be seen in FIG. 1, the vessel hull includes a wall and external base 1, a double internal base 2, and a double internal wall 3. Between the wall and the external base and the double wall and the double internal base is placed the hull structure of the vessel. The vessel also has transverse bulkheads 4 which, together with double internal wall 3, define the walls of the hold of the vessel.

On the hull structure of the vessel is mounted the support wall, made up of a cylindrical or truncated shaped wall 5. A series of brackets 6 are positioned with its sloping edge below rod 7, said rod terminating at platform 8 which is substantially horizontal. A series of partitions and intermediate reinforcement elements are also provided.

At the top of platform 8 are the covering(s) 9 which make up the support on which the tank is mounted. As may be seen in FIGS. 1–7, platform 8 extends transversely to the double sheathing 3 of the hull as well as to the transverse bulkheads 4. Platform 8 has a central opening through which the tank mounted on shell or covering 9 passes.

In accordance with the invention, there is placed on top of platform 8 a continuous sheet or member 10 which is parallel to the platform 8. As may be better seen in FIG. 2, between sheet 10 and platform 8 there is placed an intermediate connecting element 11 in the form of a continuous curved outline. The edge of one of the free walls of this outline joins the free edge of sheet 10, while the free edge of the other wall of curved outline 11 joins the free edge of platform 8. Also, between sheet 10 and platform 8 is placed a deformable element made up of an elastic body 12, located directly beneath the resting zone of tank support covering(s) 9, said elastic body thus remaining positioned above wall 5 inasmuch as the elastic body is facing shell or covering 9. The curved outline 11 defines a central opening large enough for the tank to pass through.

Elastic body 12 may be continuous, e.g., in the form of a ring which surrounds the intermediate connecting element 11. Elastic body 12 may also be discontinuous, based on independent pieces or portions also situated beneath the area where tank support covering(s) 9 meet with continuous sheet 10.

Between elastic body 12 and the intermediate connection element 11, there may be a second intermediate connection element 13, represented by the broken lines (see FIGS. 2 and 3), an element which is made up of a partition perpendicular to the continuous sheet 10 and platform 8, to which it is welded along its longitudinal edges.

Figure 2:
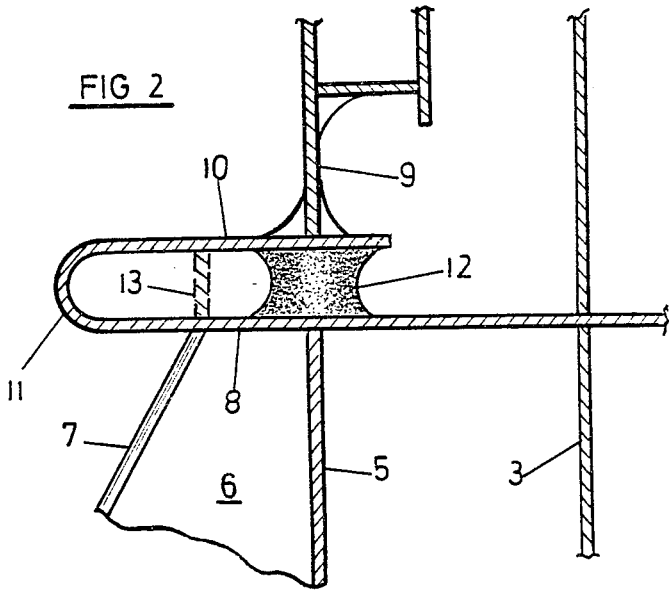
FIG. 2 is a partial vertical section of FIG. 1 of the area where the tank support coverings rest upon the deformable element and the platform.
Figure 3:
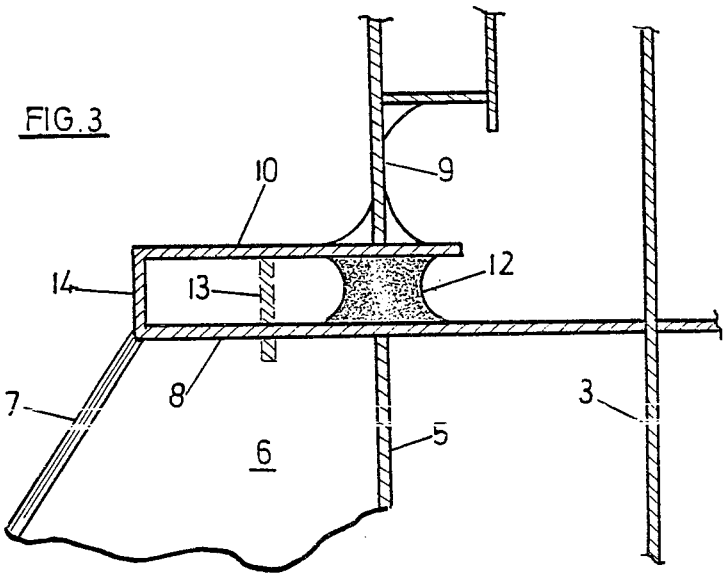
FIG. 3 is a view similar to FIG. 2 showing another embodiment where the deformable element surrounds the intermediate element(s) as in the case of FIG. 2.

Curved outline 11 may be replaced by a simple vertical wall 14, as shown in FIG. 3, which is perpendicular to continuous sheet 10 and platform 8, and to which it is welded or otherwise joined along its free edges. This embodiment may also be reinforced with a second intermediate element 13 identical to the one described in respect to FIG. 2.

Figure 4:
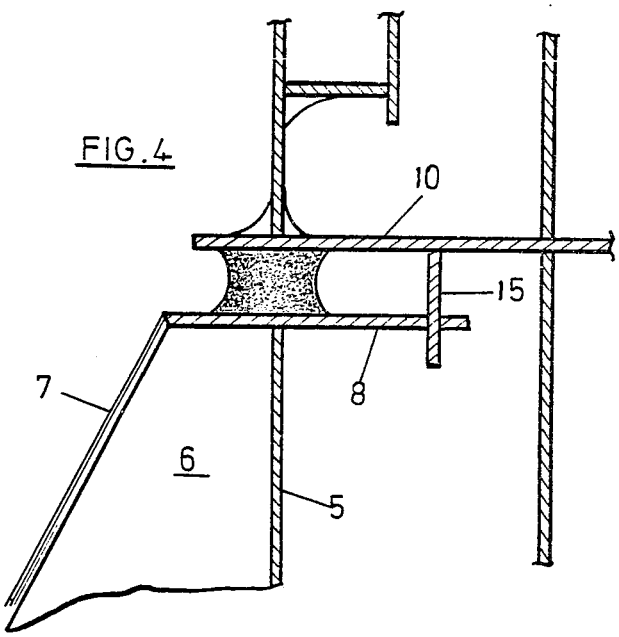
FIGS. 4 and 5 are views similar to FIG. 2 where the intermediate element(s) are located outside the deformable element.

In the embodiment shown in FIG. 4, the intermediate element, as in FIG. 3, is made up of a vertical partition 15 placed perpendicular to platform 8 and continuous sheet 10 and which is welded to them.

Figure 5:
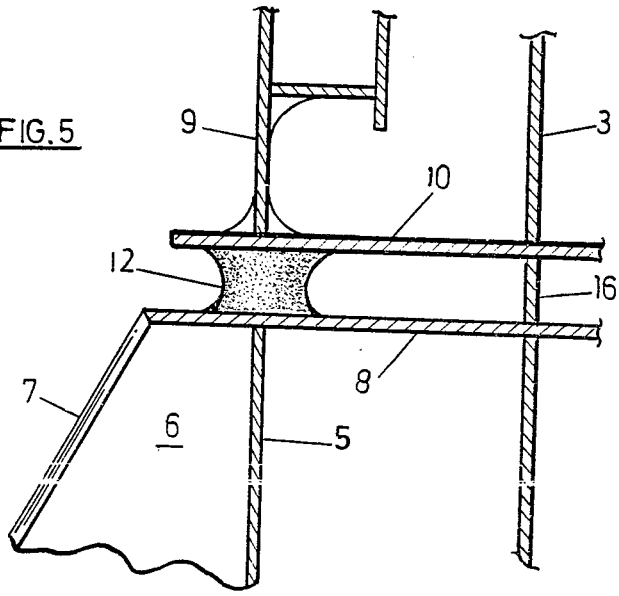

In FIG. 5, platform 8 extends to the transverse bulkhead 4 or double internal sheathing 3, activating the portion of said transverse bulkhead or double sheathing 16 which is between continuous sheet 10 and platform 8 as an intermediate connection element.

In both FIGS. 4 and 5, the intermediate connection element surrounds elastic element 12, contrary to the effect obtained in FIGS. 2 and 3.

Figure 6:
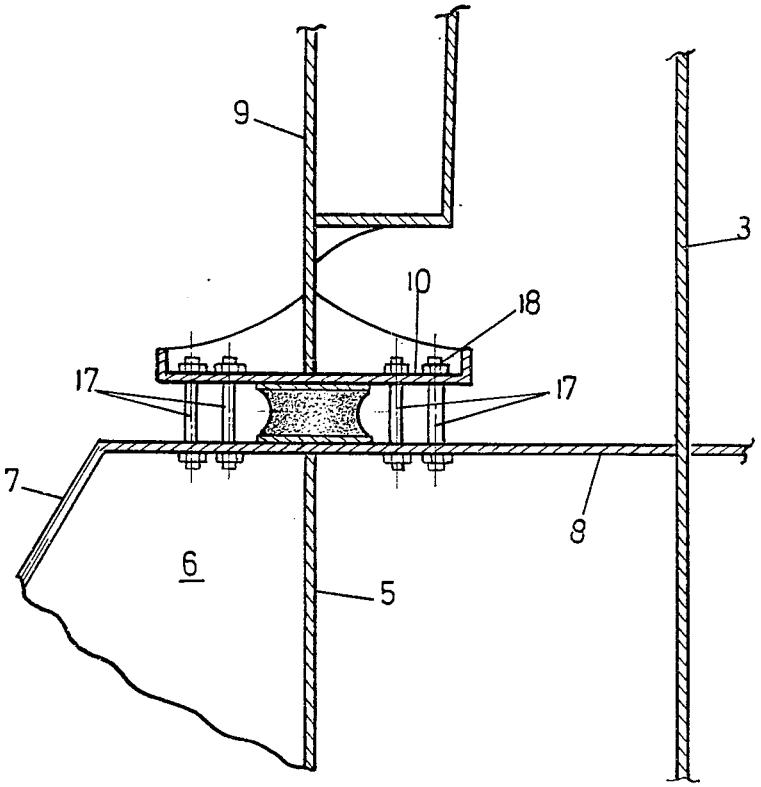
FIG. 6 is a view similar to FIG. 2 where the intermediate elements are located inside and outside the deformable element.

As shown in FIG. 6, the intermediate elements may be made up of bolts 17 which extend perpendicularly between continuous sheet 10 and platform 8. Bolts 17 are fixed by means of nuts 18. In this case continuous plate 10 does not extend to the wall of the hold defined by transverse bulkheads 4 and the double internal sheathing 3. Rather it is platform 8 which extends up to the wall of the hold.

Figure 7:
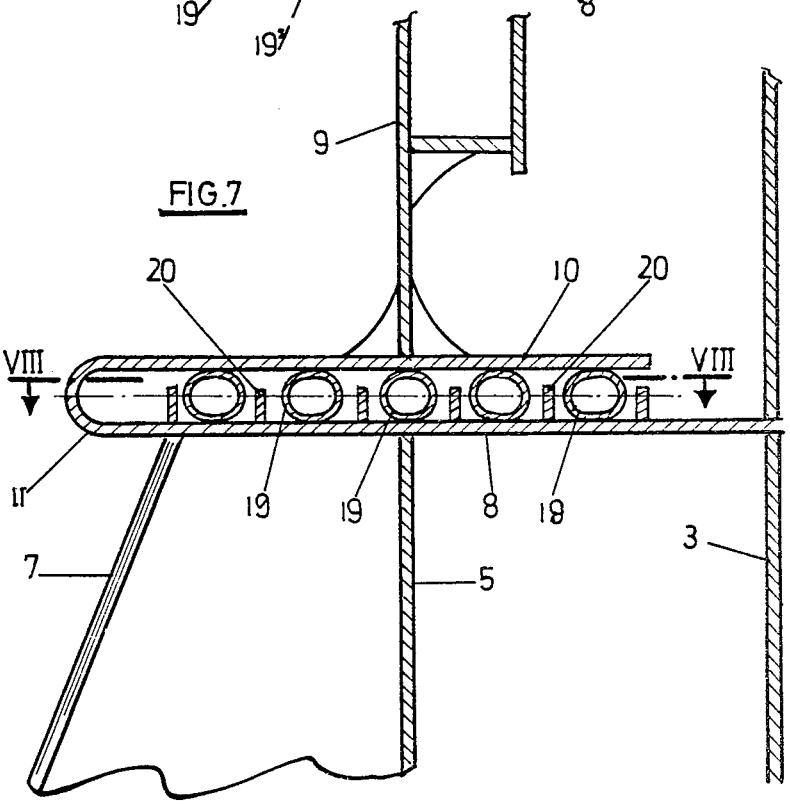
FIG. 7 is a view similar to FIG. 2 showing another embodiment of the deformable element.

In FIG. 7, the deformable element may be made up of various hermetic tubular chambers 19, five of which are shown for exemplary purposes, comprising a flexible wall which preferably have little elasticity and are partially filled with a non-compressible fluid. Chambers 19 are placed beneath the resting area of tank support covering 9 but above platform 8. Each chamber 19 is placed between two partitions 20 which rise perpendicularly above the surface of platform 8.

The intermediate element 11 may be adopted to have any of the configurations heretofore described.

Figure 8:
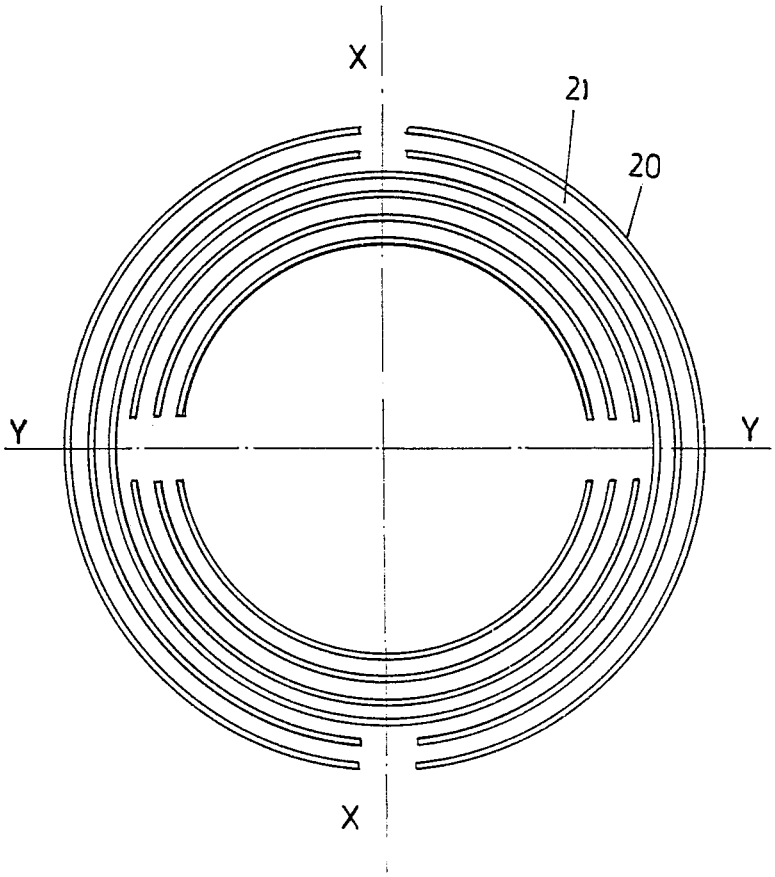
FIG. 8 is a plan view according to line 8—8 of FIG. 7.

Each partition 20 (see FIG. 8) has an approximately semicircular design, defining a compartment 21 between every two partitions. As may be seen, part of the compartments 21 are symmetrical with respect to the longitudinal plane X—X of the vessel, while the rest are symmetrical to the median transverse plane Y—Y of the tank.

In each compartment 20 is placed a ringed chamber 19 (not shown), the design of which is an arc with a circumference slightly less than 180°. All the chambers together will form four concentric series, those occupying the internal compartments are symmetrical with respect to the longitudinal plane X—X of the vessel, while those occupying the external compartments are symmetrical with respect to the median transverse plane Y—Y of the tank.

To facilitate the substitution of the chambers 19 in their respective compartments 21, without having to remove the tank, partitions 20 may have their extremities curved inwards in the internal partitions and outwards in the external partitions, so as to form openings through which the trailing empty chambers may be introduced by a suitable method. On the other hand, openings may be placed in platform 8 facing the extremes of the ringed chambers, through which the chambers may be either introduced or removed.

As has already been indicated, chambers 19 are not filled completely, so that the fluid may circulate from one area to another in each chamber.

Figure 9:
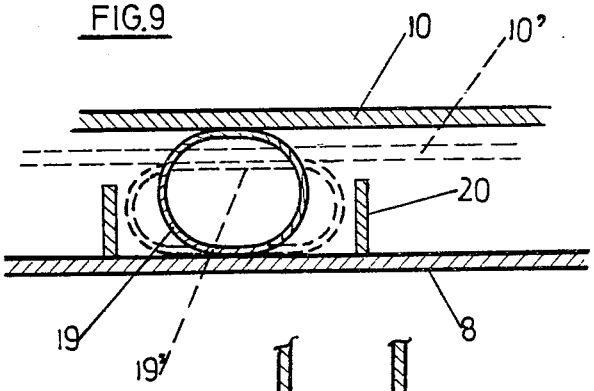
FIG. 9 is a larger scale tranverse section of one of the ringed chambers.

In FIG. 9, reference numeral 19 refers to the configuration of the cross section of the chambers when they support only the pressures coming from the weight of the tank and its foundation. When there are deformations of the hull of the vessel, in those areas where platform 8 tends to approximate continuous sheet 10, said sheet 10 will occupy, with respect to platform 8, position 10′ represented by the broken lines. The configuration of the cross section of chamber 19 will vary, adopting the form represented by broken lines referred to by 19′, where the point of contact between the chamber and platform 8 and sheet 10 has increased.

When the chamber undergoes the maximum local flattening, it is necessary that said chamber not touch partitions 20 and that sheet 10 not lean against them so that the deformation capacity of the chamber in question is not restricted.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. In a vessel equipped with at least one pressurized independent tank wherein there is at least one support covering placed above a substantially horizontally oriented platform, the improvement comprising:

means for reducing the tensions induced in the tank and its support covering due to vertical deformations of the hull of the vessel, said means including a continuous sheet located above said platform and being positioned substantially parallel to said platform, a deformable element capable of regaining its form and being placed between said continuous sheet and said platform;

said continuous sheet being connected to the platform by means of at least one intermediate element and being equipped with a central opening through which said tank can pass, said deformable element being capable of transmitting, between said continuous sheet and said platform, perpendicular forces of the hull of the vessel, said continuous sheet being constructed to transmit parallel forces of the hull of the vessel in the form of sharp pressures, while at the same time allowing vertical deformation of the deformable element.

2. The improvement according to claim 1, wherein said deformable element comprises a ring-shaped continuous elastic body, which surrounds the central opening of said continuous sheet and is positioned beneath the area where the at least one support covering of the tank and said continuous sheet come together.

3. The improvement according to claim 1, wherein said deformable element comprises independent elastic pieces located beneath the area where the at least one support covering and the continuous sheet come together.

4. The improvement according to claim 1, wherein said deformable element comprises one or more tubular chambers with flexible walls, said chambers being partially filled with a low compression fluid, said deformable element surrounding the central opening and located in the area where the at least one support covering and the continuous sheet come together.

5. The improvement according to claim 4, wherein said deformable element is made up of four series of concentric tubular chambers, two interior series and two exterior series, each chamber length having an arc slightly less than a semicircle, the two interior series being symmetrical with respect to a vertical plane, and the two exterior series being symmetrical to another vertical plane, preferably perpendicular to the former, each chamber being mounted between two partitions that rise perpendicularly above the platform, the height and separation between the partitions being such that transverse variations of the chamber are permitted without the continuous plate touching said partitions and without lateral restriction on the local flattening of the chamber.

6. The improvement according to claim 1, wherein said at least one intermediate element comprises a continuous curved member positioned inside the area occupied by said deformable element, said curved member being joined to the continuous sheet and to the platform.

7. The improvement according to claim 6, wherein said at least one intermediate element further includes a perpendicular continuous partition between said platform and said continuous sheet, which partition surrounds said intermediate element and said deformable element.

8. The improvement according to claim 1, wherein said at least one intermediate element comprises a continuous partition perpendicular to said platform and said continuous sheet, placed within the area occupied by the deformable element, and joined to the continuous sheet and to the platform.

9. The improvement according to claim 7, wherein said continuous partition surrounds said intermediate element and said deformable element.

10. The improvement according to claim 1, wherein said at least one intermediate element comprises a continuous perpendicular partition joined to said platform and said continuous sheet, said partition surrounds the deformable element and is placed between said deformable element and the walls of the hold.

11. The improvement according to claim 1, wherein said continuous sheet extends to the vessel walls of the hold and is joined to them.

12. The improvement according to claim 1, wherein said at least one intermediate element comprises bolt members placed adjacent to said deformable element between said platform and said continuous sheet.

* * * * *

UNITED STATES PATENT AND TRADEMARK OFFICE

CERTIFICATE OF CORRECTION

PATENT NO. : 4,233,921

DATED : November 18, 1980

INVENTOR(S) : Torroja et al

It is certified that error appears in the above-identified patent and that said Letters Patent are hereby corrected as shown below:

Claim 11, the phrase "vessel walls of the hold" should read --walls of the vessel hold--.

Signed and Sealed this

*Seventeenth* Day of *March 1981*

[SEAL]

*Attest:*

RENE D. TEGTMEYER

*Attesting Officer*

*Acting Commissioner of Patents and Trademarks*